US011566450B2

(12) United States Patent
Ng et al.

(10) Patent No.: US 11,566,450 B2
(45) Date of Patent: Jan. 31, 2023

(54) LOCK AND A LOCKING MECHANISM ASSOCIATED WITH THE LOCK

(71) Applicant: IGLOOCOMPANY PTE. LTD., Singapore (SG)

(72) Inventors: Matthew Mantik Ng, San Diego, CA (US); Chun Chiang Chan, Singapore (SG)

(73) Assignee: IGLOOCOMPANY PTE. LTD., Singapore (SG)

( * ) Notice: Subject to any disclaimer, the term of this patent is extended or adjusted under 35 U.S.C. 154(b) by 0 days.

(21) Appl. No.: 17/437,675

(22) PCT Filed: Mar. 10, 2020

(86) PCT No.: PCT/SG2020/050123
§ 371 (c)(1),
(2) Date: Sep. 9, 2021

(87) PCT Pub. No.: WO2020/185161
PCT Pub. Date: Sep. 17, 2020

(65) Prior Publication Data

US 2022/0090415 A1 Mar. 24, 2022

(30) Foreign Application Priority Data

Mar. 11, 2019 (SG) ..... 10201902145P

(51) Int. Cl.
*E05B 67/22* (2006.01)
*E05B 67/06* (2006.01)
*E05B 47/00* (2006.01)

(52) U.S. Cl.
CPC ..... *E05B 67/22* (2013.01); *E05B 67/063* (2013.01); *E05B 47/0001* (2013.01)

(58) Field of Classification Search
CPC ..... E05B 67/06; E05B 67/063; E05B 67/22; E05B 67/24; E05B 47/0001
See application file for complete search history.

(56) References Cited

U.S. PATENT DOCUMENTS 2,834,195 A * 5/1958 Stackhouse ..... E05B 67/24 70/423
5,839,302 A * 11/1998 Chu ..... E05B 35/12 70/38 A (Continued)

FOREIGN PATENT DOCUMENTS

KR 101305966 B1 9/2013

OTHER PUBLICATIONS

International Search Report and Written Opinion of International Searching Authority for International Application No. PCT/SG2020/050123.

(Continued)

*Primary Examiner* — Christopher J Boswell
(74) *Attorney, Agent, or Firm* — JCIP; Joseph G. Chu; Jeremy I. Maynard

(57) ABSTRACT

There is provided a lock which can include a shackle which can be moved between an unlocked configuration and a locked configuration. A locking mechanism can be carried by the lock. The locking mechanism can include a guard which can be actuated in a manner such that an access region can be defined to facilitate movement of the shackle such that the shackle can be moved to be in an unlocked configuration. The guard can also be actuated in a manner so as to block the access region to impede movement of the shackle when in the locked configuration such that the shackle is maintained in the locked configuration.

13 Claims, 3 Drawing Sheets

(56) References Cited

U.S. PATENT DOCUMENTS

| | | | | |
|---|---|---|---|---|
| 6,047,575 | A * | 4/2000 | Larson | E05B 67/22 70/38 A |
| 7,948,359 | B2 * | 5/2011 | Marcelle | E05B 67/24 70/38 A |
| 8,225,629 | B2 * | 7/2012 | Zuraski | E05B 67/24 70/279.1 |
| 8,453,481 | B2 * | 6/2013 | Meekma | E05B 67/22 70/278.1 |
| 8,850,858 | B2 * | 10/2014 | Nave | E05B 67/22 70/279.1 |
| 10,422,163 | B1 * | 9/2019 | Cabral Herrera | E05B 67/24 |
| 11,028,618 | B1 * | 6/2021 | Liu | E05B 67/22 |
| 11,105,123 | B1 * | 8/2021 | Ruffkess | E05B 67/22 |
| 2006/0283216 | A1 | 12/2006 | Marcelle et al. | |
| 2009/0282876 | A1 | 11/2009 | Zuraski et al. | |
| 2012/0011902 | A1 | 1/2012 | Meekma | |
| 2014/0208812 | A1 | 7/2014 | Da Silva Filho | |
| 2015/0225986 | A1 * | 8/2015 | Goldman | E05B 67/063 70/20 |
| 2020/0165841 | A1 * | 5/2020 | George | E05B 67/22 |
| 2021/0047865 | A1 * | 2/2021 | Tsui | E05B 67/22 |

OTHER PUBLICATIONS

International Patent Report on Patentability (Chapter II) for International Application No. PCT/SG2020/050123.

* cited by examiner

LOCK AND A LOCKING MECHANISM ASSOCIATED WITH THE LOCK

FIELD OF INVENTION

The present disclosure generally relates to a lock which can carry a locking mechanism.

BACKGROUND

The following discussion of the background to the invention is intended to facilitate an understanding of the present invention. However, it should be appreciated that the discussion is not an acknowledgment or admission that any of the material referred to was published, known or part of the common general knowledge in any jurisdiction as at the priority date of the application.

Presently a myriad of conventional electronic type or mechanical type locks (i.e., conventional locks) are available. There are various designs in relation to locking/unlocking strategies associated with such conventional locks.

The present disclosure contemplates that a lock associated with a locking mechanism which can be distinguished from the aforementioned locking/unlocking strategies associated with conventional locks.

SUMMARY OF THE INVENTION

In accordance with an aspect of the disclosure, there is provided a lock assembly. The lock assembly comprises a lock body, a shackle partially located within the lock body and configured to move relative to the lock body. The lock assembly comprises a pair of locking members within the lock body, wherein the pair of locking members are configured to movably engage the shackle to prevent movement of the shackle in a locked configuration and to movably disengage from the shackle in an unlocked configuration. The lock assembly comprises a locking mechanism coupled to the pair of locking members, wherein movement of the locking mechanism corresponds with the movement of the pair of locking members, a guard slidably engageable with the locking mechanism, wherein the guard is movable between a deployed position and a retracted position, wherein when in the deployed position, the guard is configured to slidably move the locking mechanism in such a manner as to cause the locking mechanism and the pair of locking members to move into the locked configuration, and when in the retracted position, the guard is configured to slidably move the locking mechanism in such a manner as to cause the locking mechanism and the pair of locking members to move into the unlocked configuration.

According to some embodiments of the disclosure, the lock assembly further comprises an actuating mechanism configured to engage the guard so as to cause the guard to move between the deployed position and the retracted position.

According to some embodiments of the disclosure, the lock assembly further comprises a control mechanism configured to selectively move the actuating mechanism so as to cause the guard to move between the deployed position and the retracted position.

According to some embodiments of the disclosure, the pair of locking members further comprise a first head capable of engaging and disengaging with a first pocket of the shackle and a second head capable of engaging and disengaging with a second pocket of the shackle.

According to some embodiments of the disclosure, the locking mechanism comprises a first support part and a second support part, each of the first and second support parts having a first end coupled to each one of the pair of locking members, and each of the first support part and second support having a second end coupled to each other.

According to some embodiments of the disclosure, the guard is slidably movable in a manner so as to create an access region in the body or to block the access region.

According to some embodiments of the disclosure, the guard is slidably movable to the retracted position such that the access region is created and configured to allow the locking mechanism to enter the access region, whereby the first support part and second support part are urged towards each other such that the pair of locking members are disengaged from the shackle.

According to some embodiments of the disclosure, the guard is slidably movable to the deployed position such that the guard blocks the access region and causes the first support part and second support part to be urged away from each other to cause the pair of locking members to engage the shackle.

According to some embodiments of the disclosure, when the shackle is in the locked configuration and the guard is blocking the access region, movement of the first support part and movement of the second support part are impeded so that the further movement of the shackle is impeded, thereby maintaining the shackle in the locked configuration.

According to some embodiments of the disclosure, when the pair of locking members are engaged with the shackle in the locked configuration, the first support part and the second support part are urged away from each other.

According to some embodiments of the disclosure, when the pair of locking members are disengaged with the shackle in the unlocked configuration, the first support part and the second support part are urged towards each other.

According to some embodiments of the disclosure, wherein the first support part corresponds to a master lever relative to the second support part and the second support part corresponds to a slave lever relative to the first support part, and wherein the master lever acts to drive the slave lever in a manner so as to facilitate ease in urging the first and second heads one of toward each other and away from each other.

According to some embodiments of the disclosure, each of the locking members corresponds to a curvilinear protrusion associable with a curvilinear surface, and wherein each of the first and second pockets corresponds to a curvilinear pocket associable with a curvilinear surface.

According to some embodiments of the disclosure, each curvilinear protrusion corresponds to a convex based curvilinear surface and each curvilinear pocket corresponds to a concave based curvilinear surface.

In accordance with a second aspect of the disclosure, there is provided a locking mechanism located within a lock body. The lock body has a shackle partially located within the lock body and configured to move relative to the lock body. The locking mechanism comprises a pair of locking members configured to movably engage the shackle to prevent movement of the shackle in a locked configuration and to movably disengage from the shackle in an unlocked configuration. An actuating mechanism is coupled to the pair of locking members, wherein movement of the actuating mechanism corresponds with the movement of the pair of locking members. The locking mechanism comprises a guard slidably mounted within the lock body, and movable between a deployed position and a retracted position, wherein the guard is configured to move the actuating mechanism in the deployed position to cause the actuating mechanism and the pair of locking members to move to the locked configuration, and the guard is configured to move the actuating mechanism in a retracted position to cause the actuating mechanism and the pair of locking members to move to the unlocked configuration.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. The dimensions of the various features or elements may be arbitrarily expanded or reduced for clarity. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced. These embodiments are described in sufficient detail to enable those skilled in the art to practice the invention. Other embodiments may be utilized and structural, and logical changes may be made without departing from the scope of the invention. The various embodiments are not necessarily mutually exclusive, as some embodiments can be combined with one or more other embodiments to form new embodiments.

Accordingly, in one or more example embodiments, the functions described may be implemented in hardware, software, or any combination thereof. If implemented in software, the functions may be stored on or encoded as one or more instructions or code on a computer-readable medium.

In the specification the term "comprising" shall be understood to have a broad meaning similar to the term "including" and will be understood to imply the inclusion of a stated integer or step or group of integers or steps but not the exclusion of any other integer or step or group of integers or steps. This definition also applies to variations on the term "comprising" such as "comprise" and "comprises".

The term "coupled" (or "connected") herein may be understood as electrically coupled or as mechanically coupled, for example attached or fixed, or just in contact without any fixation, and it will be understood that both direct coupling or indirect coupling (in other words: coupling without direct contact) may be provided.

Figure 1:
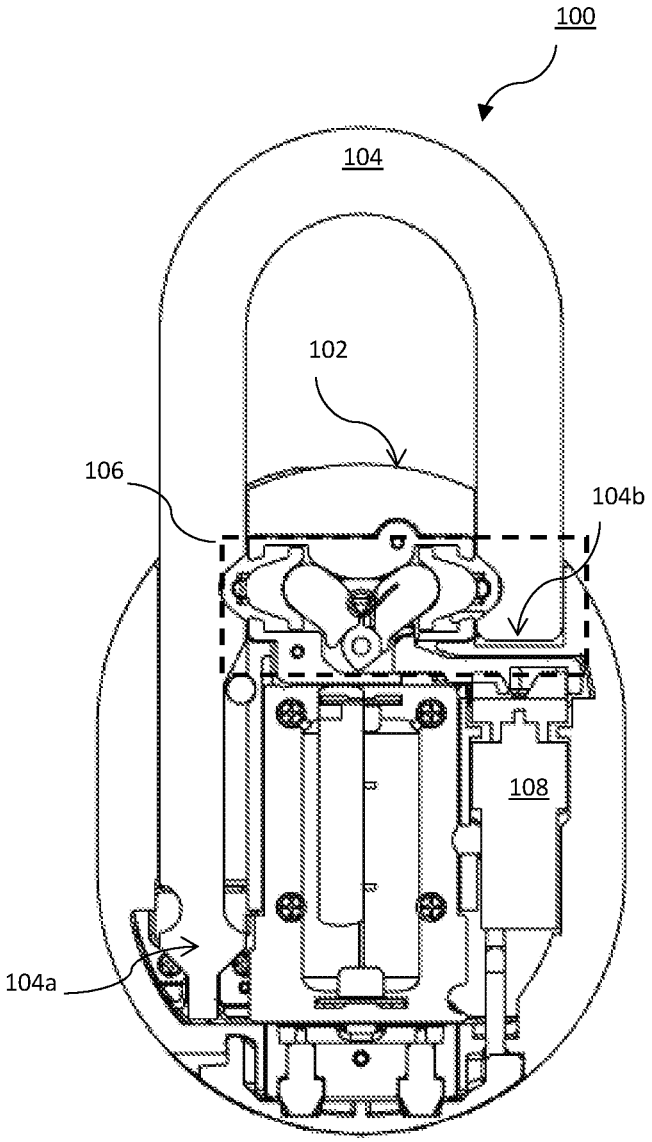
FIG. 1 shows a lock which can include a shackle which can be in either a locked configuration or an unlocked configuration, according to an embodiment of the disclosure.

FIG. 1 shows a lock 100 in accordance with an embodiment of the disclosure. The lock 100 can, for example, correspond to a padlock. The lock 100 can, for example, correspond to an electronic type lock (e.g., an electronic padlock) or a non-electronic type lock (e.g., a mechanical/analog padlock).

The lock 100 can include a body 102, a shackle 104 and a locking mechanism 106. The lock 100 can, as an option, further include an actuating mechanism 108. The lock can, as a further option, further include a control mechanism (not shown).

The body 102 and the shackle 104 can be coupled. Additionally, the body 102 can be shaped and dimensioned in a manner so as to carry the locking mechanism 106. The shackle 104 and the locking mechanism 106 can be coupled. Moreover, according to an embodiment of the disclosure, the body 102 can be shaped and dimensioned in a manner so as to carry the actuating mechanism 108 and the control mechanism. In one embodiment, the actuating mechanism 108 and the control mechanism can be coupled, and the actuating mechanism 108 can be coupled to the locking mechanism 106.

The body 102 can, for example, correspond to a casing/chassis, according to an embodiment of the disclosure.

The shackle 104 can generally be moved in a manner so as to be in either an unlocked configuration or a locked configuration. Specifically, the shackle 104 can be moved between an unlocked configuration and a locked configuration. More specifically, the shackle 104 can be moved relative to the body 102 so as to be in either the unlocked configuration or the locked configuration. Moreover, the shackle 104 (e.g., in the form of a U-shaped bar) can include a heel end 104*a* and a toe end 104*b*. The heel end 104*a* and the toe end 104*b* can define the ends of the shackle 104. Specifically, the heel end 104*a* can correspond to one end of the shackle 104 and the toe end 104*b* can correspond to another end of the shackle 104.

The locking mechanism 106 can be configured in a manner so as to facilitate/allow movement of the shackle 104 such that the shackle 104 can be in either the unlocked configuration or the locked configuration. The locking mechanism 106 can be further configured in a manner so as to maintain the shackle 104 in the locked configuration after the shackle 104 has been moved to be in the locked configuration (i.e., after the shackle 104 has been moved from the unlocked configuration to the locked configuration) .

The actuating mechanism 108 can be controlled by the control mechanism in a manner so as to be in either an access configuration or a blocking configuration. Specifically, the actuating mechanism 108 can be switched between the access configuration and the blocking configuration based on control by the control mechanism. In one embodiment, the control mechanism can be an electronic based control mechanism, and can be configured to received one or more input signals and process the input signal(s) in a manner so as to generate one or more control signals. The control signal(s) can be communicated to the actuating mechanism 108 in a manner so as to control the actuating mechanism 108. The input signal(s) can be generated by manner of user input via a user interface (not shown), such as a keypad, carried by the body 102. Appreciably, the user interface can be carried by the body 102 in a manner (e.g., carried by one face of the body 102) so as to be visually perceivable and accessible by a user.

In one embodiment, the actuating mechanism 108 can, in a specific example, correspond to a motor and the control mechanism can, in a specific example, correspond to an electronics circuit board which can include a microcontroller.

In an exemplary situation, the shackle 104 can initially be in the locked configuration. To facilitate movement of the shackle 104 so that the shackle 104 can be in the unlocked configuration, one or more control signals can be communicated from the control mechanism such that the actuating mechanism 108 is in the access configuration so as to allow the locking mechanism 106 to facilitate/allow movement of the shackle 104 to the unlocked configuration. Subsequently, while the actuating mechanism 108 is in the access configuration, the shackle 104 can be moved so as to be in either the unlocked configuration or the locked configuration. Specifically, the shackle 104 can be moved in a manner so as to be in the unlocked configuration (i.e., from the locked configuration). More specifically, the shackle 104 can be moved from the locked configuration (i.e., initial) to the unlocked configuration (i.e., subsequent).

In another exemplary situation, the shackle 104 can initially be in the unlocked configuration. Appreciably, the actuating mechanism 108 can be in the access configuration and the shackle 104 can be moved in a manner so as to subsequently be in the locked configuration (i.e., from the unlocked configuration). To maintain the shackle 104 in the locked configuration (i.e., after the shackle 104 has been moved to be in the locked configuration), one or more control signals can be communicated to the control mechanism such that the actuating mechanism 108 switched (i.e., from the access configuration) to the blocking configuration. After the actuating mechanism 108 has been switched to the blocking configuration, further movement of the shackle 104 can be impeded. Specifically, after the actuating mechanism 108 is switched to the blocking configuration (i.e., after the shackle 104 has been moved to the locked configuration), further movement of the shackle 104 to be in the unlocked configuration can be impeded.

The locking mechanism 106 will now be discussed in further detail with reference to FIG. 2 and FIG. 3 hereinafter.

Figure 2:
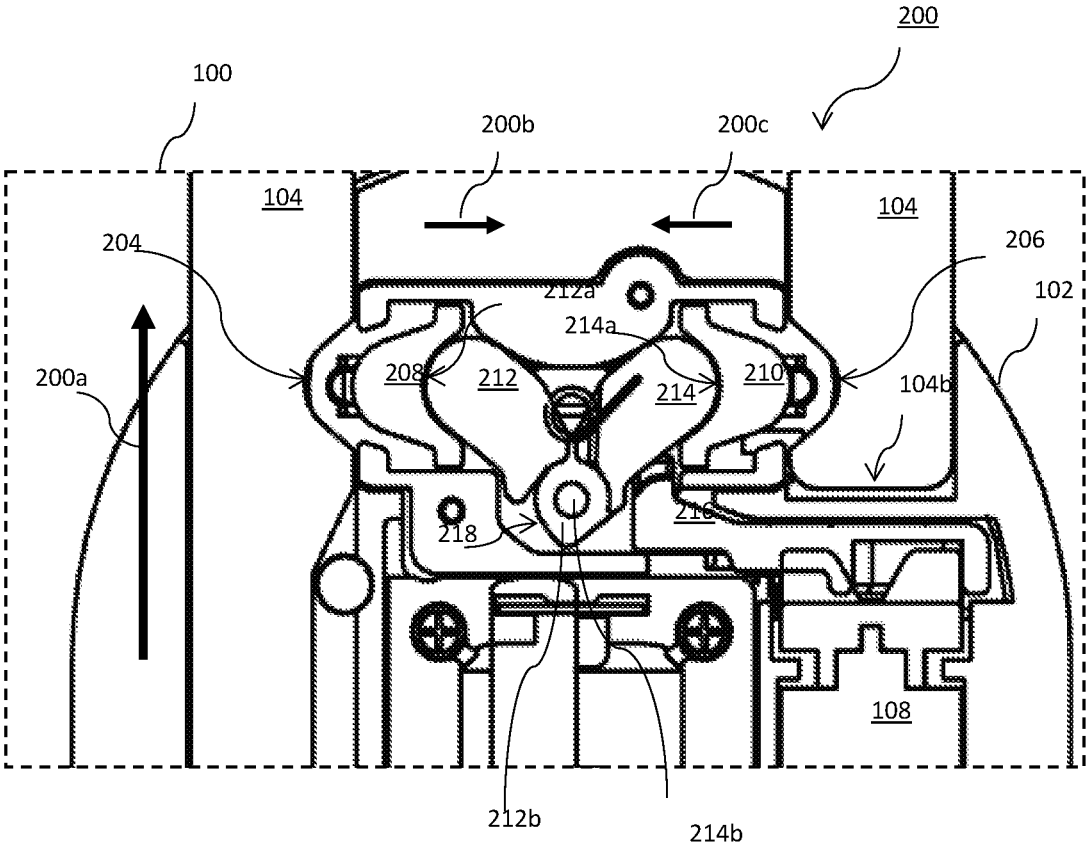
FIG. 2 shows that the lock of FIG. 1 can be unlocked in the sense that the shackle is in the unlocked configuration.

Specifically, the locking mechanism 106 will be further discussed in the context of the shackle 104 being in the unlocked configuration as shown in FIG. 2, according to an embodiment of the disclosure. The locking mechanism 106 will yet be further discussed in the context of the shackle 104 being in the locked configuration as shown in FIG. 3, according to an embodiment of the disclosure.

FIG. 2 shows, according to an embodiment of the disclosure, that the lock 100 is unlocked in the sense that the shackle 104 is in an unlocked configuration 200.

In one embodiment, the shackle 104 can be shaped and dimensioned in a manner such that a first pocket 204 and a second pocket 206 can be defined. For example, the first pocket 204 can be defined nearer to the heel end 104*a* as compared to the toe end 104*b*, and the second pocket 206 can be defined nearer to the toe end 104*b* as compared to the heel end 104*a*.

Each of the first and second pockets 204/206 can be in the form of a curvilinear pocket, according to an embodiment of the disclosure. In this regard, in one embodiment, the first pocket 204 can correspond to a first curvilinear pocket and the second pocket 206 can correspond to a second curvilinear pocket. Appreciably, each of the first and second pockets 204/206 can be associated with a curvilinear surface, according to an embodiment of the disclosure. For example, each of the first and second pockets 204/206 can be associated with a concave based curvilinear surface.

Moreover, the locking mechanism 106 can include a pair of locking members. Each of the locking members include a first head 208, a second head 210, a first support part 212 and a second support part 214. A first locking member can correspond with the first head 208 and the first support part 212, and a second locking member can correspond with the second head 210 and the second support part 214. The locking mechanism 106 can further include a guard 216.

Each of the locking members can be in the form of a curvilinear protrusion (e.g., a rounded bolt), according to an embodiment of the disclosure. In this regard, in one embodiment, the first head 208 can correspond to a first curvilinear protrusion (e.g., a first rounded bolt) and the second head 210 can correspond to a second curvilinear protrusion (e.g., a second rounded bolt). Appreciably, each of the first and second heads 208/210 can be associated with a curvilinear surface, according to an embodiment of the disclosure. For example, each of the first and second heads 208/210 can be associated with a convex based curvilinear surface.

The first support part 212 can include a first end 212*a* and a second end 212*b*. The first and second ends 212*a*/212*b* can define the extremities of the first support part 212. Specifically, the first and second ends 212*a*/212*b* can be opposing ends of the first support part 212. The first support part 212 can correspond to a lever (e.g., a spring-loaded lever), according to an embodiment of the disclosure. For example, the first support part 212 can correspond to a first lever. In a more specific example, the first support part 212 can correspond to a first spring-loaded lever.

The second support part 214 can include a first end 214*a* and a second end 214*b*. The first and second ends 214*a*/214*b* can define the extremities of the second support part 214. Specifically, the first and second ends 214*a*/214*b* can be opposing ends of the second support part 214. The second support part 214 can correspond to a lever (e.g., a spring-loaded lever), according to an embodiment of the disclosure. For example, the second support part 214 can correspond to a second lever. In a more specific example, the second support part 214 can correspond to a second spring-loaded lever.

According to an embodiment of the disclosure, one of the support parts (e.g., the first support part 212) can be a master support part relative to another one of the support parts (e.g., the second support part 214). In this regard, it is appreciable that one support part (e.g., the second support part 214) can be considered to be a slave support part relative to another support part (e.g., the first support part 212). In one example, the master support part can correspond to a master lever (e.g., the first support part 212) whereas the slave support part can correspond to a slave lever (e.g., the second support part 214). The master lever can be capable of driving the slave lever.

The guard 216 (e.g., corresponding to a sliding guard) is slidably engagegable with the locking mechanism 106. The guard 216 is slidably mounted within the lock body such that it is movable between a deployed position and a retracted position. In other words, the guard 216 can be actuated in a manner so as to either allow movement of the first and second support parts 212/214 or impede movement of the first and second support parts 212/214. This will be discussed later in further detail.

Additionally, in regard to the locking mechanism 106, the first head 208 can be coupled to the first support part 212 and the second head 210 can be coupled to the second support part 214. Moreover, the first support part 212 can be coupled to the second support part 214. Specifically, the first end 212*a* of the first support part 212 can be coupled to the first head 208, the first end 214*a* of the second support part 214 can be coupled to the second head 210 and the second end 212*b* of the first support part 212 can be coupled to the second end 214*b* of the second support part 214.

Generally, the first pocket 204 can be aligned (i.e., positionally aligned) in respect of the first head 208 whereas the second pocket 206 can be aligned (i.e., positionally aligned) in respect of the second head 210. Specifically, the first pocket 204 can be shaped and dimensioned in a manner so as to be capable of receiving and accommodating the first head 208, and the second pocket 206 can be shaped and dimensioned in a manner so as to be capable of receiving and accommodating the second head 210. In this regard, the first pocket 204 can be capable of mating with the first head 208 whereas the second pocket 206 can be capable of mating with the second head 210. Appreciably, each of the first and second pockets 204/206 can be considered to be a receiving part whereas each of the first and second heads 208/210 can be considered to be a mating part (i.e., which can be capable of mating with a corresponding receiving part). Specifically, the first pocket 204 and first head 208 can be considered to be a first pair of receiving and mating parts whereas the second pocket 206 and the second head 210 can be considered to be a second pair of receiving and mating parts.

Earlier mentioned, the guard 216 can be actuated in a manner so as to either allow movement of the pair of locking members or impede movement of the locking members. When the guard is in a deployed position (as shown in FIG. 3), the guard is slidably engageable with the locking mechanism and configured to move the locking mechanism and the pair of locking members into the locked configuration. This causes the locking members to be urged away from each other and into the corresponding receiving first and second pockets of the shackle. In the deployed position, the shackle is in the locked configuration and a user is unable to open the lock without authorized access. When the guard is in the retracted position (as shown in FIG. 2), the guard is slidably engageable with the locking mechanism and configured to move the pair of locking members into the unlocked configuration. This causes the locking members to be urged towards each other and away from the corresponding receiving first and second pockets of the shackle. In the retracted position, the shackle is in the unlocked configuration and the user is able to open the lock without authorized access.

As shown in FIG. 2, and in other embodiments, the guard 216 has been actuated in a manner such that movement of the first and second support parts 212/214 can be allowed. Specifically, the guard 216 can be actuated in a manner such that an access region 218 can be defined within the body 102.

In an exemplary scenario, the first head and second heads 208/210 can initially be mated with the first and second pockets 204/206 respectively, and the toe end 104*b* can be accommodated within the body 102 (i.e., the toe end 104*b* is carried within the body 102 and cannot be, for example, not visually perceivable from the outside of the body 102 if the body 102 is opaque). As the shackle 104 is moved (e.g., by a user by manner of pulling the shackle 104) so as to be effectively drawn away (i.e., as depicted by directional arrow 200*a*) from the body 102, the first and second pockets 204/206 (e.g., curvilinear pockets) can be urged against the first and second heads 208/210 (e.g., curvilinear protrusions) respectively (i.e., the first and second heads 208/210 can be urged against the first and second pockets 204/206 respectively). As the first and second pockets 204/206 (e.g., each being associated with a concave based curvilinear surface) are continuously urged against the first and second heads 208/210 (e.g., each being associated with a convex based curvilinear surface) by virtue of the shackle 104 being continually drawn away from the body 102, the second ends 212*b*/214*b* (i.e., of the first and second support parts 212/214) can be moved/urged toward (i.e., into) the access region 218. As the second ends 212*b*/214*b* are moved/urged into the access region 218 (i.e., akin to a collapse motion where the second ends 212*b*/214*b* collapse into the access region 218), it is appreciable that the first and second heads 208/210 are urged toward each other (i.e., as depicted by directional arrow 200*b* and directional arrow 200*c*) and, at the same time, away from, respectively, the first and second pockets 204/206. Therefore, the first head and second heads 208/210 can be considered to be no longer mated (i.e., unmated) with the first and second pockets 204/206 respectively. Specifically, the first head and second heads 208/210 can be considered to be unmated from the first and second pockets 204/206 respectively. When the shackle 104 has been drawn away from the body 102 to such extent that the toe end 104*b* is drawn from within the body 102 to outside of the body 102 and that the toe end 104*b* is exposed to view, the shackle 104 can be considered to be in the unlocked configuration 200 (i.e., the lock 100 can be considered to be unlocked. For example, the shackle 104 can be considered to be an "Opened" shackle and/or the body 102 can be considered to be an "Unlocked" body).

In the above-mentioned exemplary scenario, the first and second pockets 204/206 can be considered to be capable of being continuously urged against, respectively, the first and second heads 208/210 in a slidable manner (i.e., slidably urged). Specifically, the concave based curvilinear surface associated with the first pocket 204 can be slidably urged against the convex based curvilinear surface associated with the first head 208 whereas the concave based curvilinear surface associated with the second pocket 206 can be slidably urged against the convex based curvilinear surface associated with the second head 210. Moreover, it is appreciable that the first and second pockets 204/206 can be simultaneously urged against the first and second heads 208/210 respectively as the shackle 104 is moved in a manner (e.g., by a user by manner of pulling the shackle 104) so as to be effectively drawn away from the body 102.

In this regard, it is appreciable that the shackle 104 can be moved relative to the body 102 by manner of the shackle 104 being drawn away (i.e., as depicted by directional arrow 200*a*) from the body 102 so as to be in the unlocked configuration 200.

In one embodiment, the first support part 212 can be configured to be a master support part (e.g., a master lever) relative to the second support part 214 and the second support part 214 can be configured to be a slave support part (e.g., a slave lever) relative to the first support part 212. For example, the first support part 212 can correspond to a master lever and the second support part 214 can correspond to a slave lever. In the above-mentioned exemplary scenario, in one embodiment, when the first pocket 204 is urged against the first head 208 and, simultaneously, the second pocket 206 is urged against the second head 210, the master lever can act to drive (e.g., assert additional force such as mechanical force) the slave lever in a manner so as to facilitate ease in urging the first and second heads 208/210 toward (i.e., as depicted by directional arrows 200*b*/200*c*) each other.

In one embodiment, the guard 216 can, for example, correspond to a sliding guard and can, for example, be actuated by the actuating mechanism 108 (e.g., a motor). Specifically, the guard part 216 can be coupled to the actuating mechanism 108, according to an embodiment of the disclosure. The actuating mechanism 108 can be configured to actuate the guard part 216 such that the access region 218 can be defined and movement of the first and second support parts 212/214 can be allowed. In this regard, in the context of the above-mentioned exemplary scenario, the actuating mechanism 108 can be considered to be in the access configuration (i.e., when the actuating mechanism 108 actuates the guard part 216 such that the access region 218 is defined and movement of the first and second support parts 212/214 can be allowed). Earlier mentioned, in one embodiment, control signal(s) can be communicated from the control mechanism such that the actuating mechanism 108 is in the access configuration.

Figure 3:
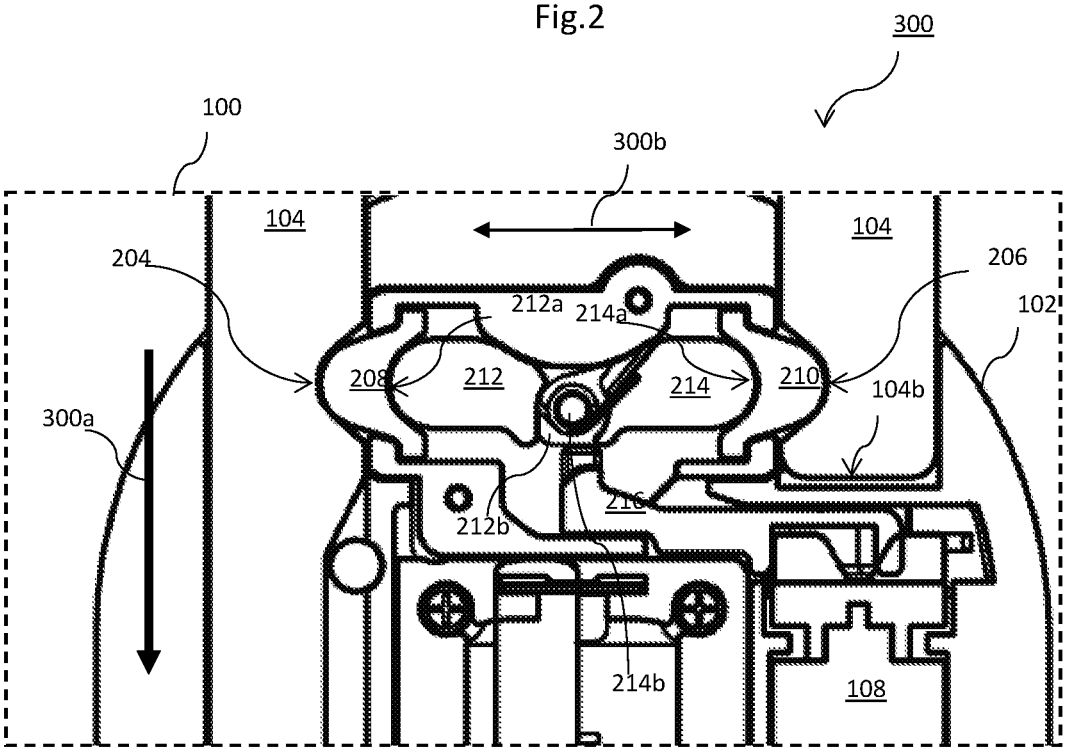
FIG. 3 shows that the lock FIG. 1 can be locked in the sense that the shackle is in the locked configuration.

FIG. 3 shows, according to an embodiment of the disclosure, that the lock 100 is locked in the sense that the shackle 104 is in a locked configuration 300.

As shown, when in the locked configuration 300, the first and second heads 208/210 can be mated, respectively, with the first and second pockets 204/206. More specifically, when the shackle is in the locked configuration 300, the first and second heads 208/210 can be accommodated within, respectively, the first and second pockets 204/206. Moreover, when in the locked configuration 300, the guard 216 can impede movement of the first and second support parts 212/214.

With reference to the earlier mentioned exemplary scenario (i.e., where the shackle 104 has been moved to be in the unlocked configuration 200 such that the lock 100 is unlocked), after the lock 100 has been unlocked and the user subsequently desires for the lock 100 to be locked, the shackle 104 can be moved in a manner (e.g., by a user by manner of pushing the shackle 104 so as to be effectively drawn toward, as depicted by directional arrow 300*a*, the body 102) so as to be in the locked configuration 300 (i.e., from the unlocked configuration 200). Specifically, the shackle 104 can be moved such that the first and second heads 208/210 can be mated, respectively, with the first and second pockets 204/206, and the guard part 216 can be actuated in a manner so as to block the access region 218. Appreciably, when the access region 218 is blocked, further movement of the first and second support parts 212/214 (i.e., after the first and second heads 208/210 have been mated, respectively, with the first and second pockets 204/206) can effectively be impeded. In this regard, it is further appreciable that the shackle 104 can be maintained in the locked configuration 300 after the shackle 104 has been moved from the unlocked configuration 200 to the locked configuration 300.

For example, earlier mentioned, the toe end 104*b* can be outside of the body 102 (i.e., exposed to view/visually perceivable) when the shackle 104 is in the unlocked configuration 200 (i.e., the lock 100 can be considered to be unlocked). When the shackle 104 is moved from unlocked configuration 200 to be in the locked configuration 300 (e.g., by a user by manner of pushing the shackle 104 so as to be effectively drawn toward the body 102), it is appreciable that the toe end 104*b* can be drawn toward, and subsequently into, the body 102. After the toe end 104*b* is within the body 102, it is appreciable that the toe end 104*b* is hidden from view (i.e., no longer visually perceivable/no longer exposed to view if the body 102 is opaque).

In this regard, the shackle 104 can, for example, be considered to be a "Closed" shackle. As the shackle 104 is moved (e.g., by a user by manner of pushing the shackle 104) so as to be effectively drawn toward the body 102, the first and second pockets 204/206 (e.g., curvilinear pockets) can be urged against the first and second heads 208/210 (e.g., curvilinear protrusions) respectively (i.e., the first and second heads 208/210 can be urged against the first and second pockets 204/206 respectively). As the first and second pockets 204/206 (e.g., each being associated with a concave based curvilinear surface) are continuously urged against the first and second heads 208/210 (e.g., each being associated with a convex based curvilinear surface) by virtue of the shackle 104 being continually drawn toward (i.e., as depicted by directional arrow 300*a*) the body 102, the second ends 212*b*/214*b* (i.e., of the first and second support parts 212/214) can be moved/urged away from (i.e., out of) the access region 218. As the second ends 212*b*/214*b* are moved/urged out of the access region 218, it is appreciable that the first and second heads 208/210 are urged away from each other (i.e., as depicted by double-headed arrow 300*b*) and, at the same time, toward, the first and second pockets 204/206 respectively. Subsequently, the first and second heads 208/210 can be mated with the first and second pockets 204/206 (e.g., when the second ends 212*b*/214*b* are outside of the access region 218). Moreover, it is appreciable that the first and second pockets 204/206 can be simultaneously urged against the first and second heads 208/210 respectively as the shackle 104 is moved in a manner (e.g., by a user by manner of pushing the shackle 104) so as to be effectively drawn toward the body 102. The first and second pockets 204/206 can be considered to be capable of being continuously urged against, respectively, the first and second heads 208/210 in a slidable manner (i.e., slidably urged). Specifically, the concave based curvilinear surface associated with the first pocket 204 can be slidably urged against the convex based curvilinear surface associated with the first head 208 whereas the concave based curvilinear surface associated with the second pocket 206 can be slidably urged against the convex based curvilinear surface associated with the second head 210.

In this regard, it is appreciable that the shackle 104 can be moved relative to the body 102 by manner of the shackle 104 being drawn toward (i.e., as depicted by directional arrow 300*a*) the body 102 so as to be in the locked configuration 300.

The guard 216 can be actuated in a manner so as to block the access region 218 so that the shackle 104 can be maintained in the locked configuration 300 after the shackle 104 has been moved from the unlocked configuration 200 to be in the locked configuration 300. In this regard, the body 102 can, for example, be considered to be a "locked" body.

In one embodiment, as the second ends 212*b*/214*b* are moved/urged out of the access region 218, the guard part can be actuated simultaneously to block the access region 218. Specifically, the guard 216 can be actuated in a manner such that as the second ends 212*b*/214*b* are progressively moved/urged out of the access region 218, the guard 216 progressively blocks the access region 218.

In another embodiment, the guard 216 can be actuated to block the access region 218 after the second ends 212*b*/214*b* have been completely moved/urged out of the access region 218.

Earlier mentioned, in one embodiment, the guard 216 (e.g., corresponding to a sliding guard) can, for example, be actuated by the actuating mechanism 108 (e.g., a motor). Specifically, the guard 216 can be coupled to the actuating mechanism 108, according to an embodiment of the disclosure. The actuating mechanism 108 can be configured to actuate the guard part 216 such that the access region 218 can be blocked and movement of the first and second support parts 212/214 can be impeded. In this regard, the actuating mechanism 108 can be considered to be in the blocking configuration (i.e., when the actuating mechanism 108 actuates the guard 216 such that the access region 218 is blocked and movement of the first and second support parts 212/214 can be impeded). In one embodiment, control signal(s) can be communicated from the control mechanism such that the actuating mechanism 108 is in the blocking configuration.

Moreover, with reference to the earlier mentioned exemplary scenario where, in one embodiment, the first support part 212 can be configured to be a master support part (e.g., a master lever) relative to the second support part 214 and the second support part 214 can be configured to be a slave support part (e.g., a slave lever) relative to the first support part 212, it is appreciable that when the first pocket 204 is urged against the first head 208 and the second pocket 206 is simultaneously urged against the second head 210, the master lever can act to drive (e.g., assert additional force such as mechanical force) the slave lever in a manner so as to facilitate ease in urging the first and second heads 208/210 away from (i.e., as depicted by double-headed arrow 300*b*) each other.

To put the foregoing discussion in general perspective, it is appreciable that a lock 100 is provided according to an aspect of the disclosure and a locking mechanism 106 can be associated with the lock 100. Specifically, the locking mechanism 106 can be carried by the lock 100 (i.e., the lock 100 can include the locking mechanism 106).

The lock 100 can include a shackle 104 which can be moved between a locked configuration 300 and an unlocked configuration 200. Additionally, the shackle 104 can be shaped and dimensioned in a manner such that a first pocket 204 and a second pocket 206 can be defined.

In regard to the locking mechanism 106, the locking mechanism 106, as earlier discussed, can include a first head 208, a second head 210, a first support part 212 and a second support part 214. The locking mechanism 106 can further include a guard part 216.

The first head 208 can be either mated with the first pocket 204 or unmated from the first pocket 204. Additionally, the second head 210 can be either mated with the second pocket 206 or unmated from the second pocket 206.

Each of the first and second support parts 212/214 can include a first end 212*a*/214*a* and a second end 212*b*/214*b*. The first head 208 can be coupled to the first end 212*a* of the first support part 212. The second head 210 can be coupled to the first end 214*a* of the second support part 214. Moreover, the second end 212*b* of the first support part 212 can be coupled to the second end 214*b* of the second support part 214.

The guard 216 can be actuated in a manner so as to either define an access region 218 or block the access region 218.

When the shackle 104 is initially in the locked configuration 300, the guard 216 can be actuated such that the access region 218 can be defined so as to allow movement of the shackle 104 to be in the unlocked configuration 200. Specifically, the shackle 104 can be moved (i.e., to be in the unlocked configuration 200) such that:

- the second ends 212*b*/214*b* are urged toward/into the access region 218
- the first and second heads 208/210 are unmated from the first and second pockets 204/206 respectively When the shackle 104 is initially in the unlocked configuration 200, the guard part 216 can be actuated so as to block the access region 218 after the shackle 104 has been moved to be in the locked configuration 300. Specifically, the shackle 104 can be moved (i.e., to be in the locked configuration 300) such that:

- the second ends 212*b*/214*b* are urged away from, or out of, the access region 218
- the first and second heads 208/210 are mated to the first and second pockets 204/206 respectively In regard to the lock 100, the lock 100 can further include a body 102 (i.e., in addition to the shackle 104 and the locking mechanism 106). The locking mechanism 106 can be carried by the body 102.

Earlier mentioned, the locking mechanism 106 can include a first head 208, a second head 210, a first support part 212 and a second support part 214. The locking mechanism 106 can further include a guard part 216.

In regard to the first and second heads 208/210, the first head 208 can be either mated with the first pocket 204 or unmated from the first pocket 204, and the second head 210 can be either mated with the second pocket 206 or unmated from the second pocket 206. In one specific example, each of the first and second heads 208/210 can correspond to a curvilinear protrusion which can be associated with a curvilinear surface, and each of the first and second pockets 204/206 can correspond to a curvilinear pocket which can be associated with a curvilinear surface. In a more specific example, each curvilinear protrusion can correspond to a convex based curvilinear surface and each curvilinear pocket can correspond to a concave based curvilinear surface.

In one example, when the shackle 104 is in the locked configuration 300, the first and second heads 208/210 can be mated to the first and second pockets 204/206 respectively. Moreover, when the first and second heads 208/210 are mated to the first and second pockets 204/206 respectively, the first and second heads 208/210 can be considered to be positionally urged away from each other (i.e., the first and second heads 208/210 are urged in opposite directions away from each other). Specifically, the first head 208 can be urged toward a direction which is opposite relative to the direction toward which the second head 210 is urged.

In another example, when the shackle 104 is in the unlocked configuration 200, the first and second heads 208/210 can be unmated from the first and second pockets 204/206 respectively. Moreover, when the first and second heads 208/210 are unmated from the first and second pockets 204/206 respectively, the first and second heads 208/210 can be considered to be positionally urged toward each other. Specifically, the first and second heads 208/210 can be urged toward each other and, at the same time, away from the first and second pockets 204/206 respectively.

In regard to the first and second support parts 212/214, each of the first and second support parts 212/214 can include a first end 212*a*/214*a* and a second end 212*b*/214*b*. The first head 208 can be coupled to the first end 212*a* of the first support part 212 and the second head 210 can be coupled to the first end 214*a* of the second support part 214.

Moreover, the second ends 212*b*/214*b* can be coupled to each other. Specifically, the second end 212*b* of the first support part 212 can be coupled to the second end 214*b* of the second support part 214.

In one example, the first support part 212 can correspond to a master lever relative to the second support part 214 and the second support part 214 can correspond to a slave lever relative to the first support part 212. The master lever can act to drive the slave lever in a manner so as to facilitate ease in the urging of the first and second heads 208/210 (i.e., either toward each other or away from each other).

The guard 216 can be actuated in a manner so as to either define an access region 218 in the body 102 or block the access region 218.

Earlier mentioned, the shackle 104 can be moved between a locked configuration 300 and an unlocked configuration 200. Specifically, the shackle 104 can be moved relative to the body 102 so as to be in either the unlocked configuration 200 or the locked configuration 300.

In one embodiment, when the shackle 104 is moved relative to the body 102, the first and second heads 208/210 can be urged against the first and second pockets 204/206 respectively. In one example, the first and second heads 208/210 can be slidably urged against the first and second pockets 204/206 respectively. In another example, the first and second heads 208/210 can be slidably urged, respectively, against the first and second pockets 204/206 in a simultaneous manner (i.e., the first head 208 can be slidably urged against the first pocket 204 at the same time the second head 210 is slidably urged against the second pocket 206).

In one embodiment, when the shackle 104 is initially in the locked configuration 300, the guard part 216 can be actuated such that the access region 218 can be defined. Specifically, the access region 218 can be defined so as to allow the shackle 104 to be movable to be in the unlocked configuration 200. Specifically, the shackle 104 can be moved (i.e., to be in the unlocked configuration 200) such that:

- the second ends 212*b*/214*b* (i.e., of both the first and second support parts 212/214) can be urged toward/into the access region 218
- the first and second heads 208/210 can be unmated from the first and second pockets 204/206 respectively In one embodiment, when the shackle 104 is initially in the unlocked configuration 200, the guard part 216 can be actuated so as to block the access region 218. Specifically, the access region 218 can be blocked after the shackle 104 has been moved to be in the locked configuration 300. More specifically, the shackle 104 can be moved (i.e., to be in the locked configuration 300) such that:

- the second ends 212*b*/214*b* (i.e., of both the first and second support parts 212/214) are urged away from, or out of, the access region 218
- the first and second heads 208/210 are mated to the first and second pockets 204/206 respectively Moreover, in one embodiment, after the shackle 104 has been moved to be in the locked configuration 300 and after the guard part 216 blocks the access region 218, movement of both the first and second support parts 212/214 can be impeded so that the further movement of the shackle 104 can be impeded. In this manner, the shackle 104 can be maintained in the locked configuration 300.

Figure 4:
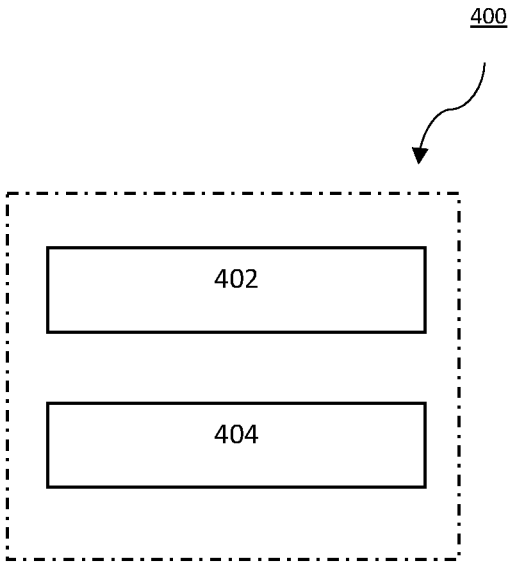
FIG. 4 shows a method in association with the lock of FIG. 1, according to an embodiment of the disclosure.

FIG. 4 shows a method 400 in association with the lock 100, according to an embodiment of the disclosure. The method 400 can be in relation to one or both of locking and unlocking the lock 100.

The method 400 can include defining a guard actuating step 402 and a drawing step 404.

In regard to the guard actuating step 402, the guard part 216 can be actuated in a manner such that an access region 218 can either be defined or blocked.

In regard to the drawing step 404, the shackle 104 can either be drawn away from the body 102 or toward the body 102. When drawn away from the body 102, the shackle 104 can be moved so as to be in the unlocked configuration 200. When drawn toward the body 102, the shackle 104 can be moved so as to be in the locked configuration 300.

It should be further appreciated by the person skilled in the art that variations and combinations of features described above, not being alternatives or substitutes, may be combined to form yet further embodiments.

In one example, it is earlier mentioned that the guard part 216 can be actuated by the actuating mechanism 108 which can correspond to a motor and which can be controlled by manner of control signal(s) being communicated from the control mechanism (e.g., an electronics circuit board). It is appreciable that the actuating mechanism 108 can be generally regarded as an electro-mechanical based actuating mechanism (i.e., electro-mechanical based actuation), according to an embodiment of the disclosure. It is further appreciable that mechanical based actuation can also be possible (e.g., inserting and turning of a physical key in connection with a mechanical arrangement of pins in a lock). Specifically, for example, the lock 100 can be a mechanical type lock which can be unlocked using a physical key and by manner of turning the inserted physical key, the guard part 216 can be actuated. In this regard, the actuating mechanism 108 can, in one embodiment, correspond to a mechanical arrangement (e.g., mechanical arrangement of pins) coupled to the guard part 216 and the guard part 216 can be actuated by such a mechanical arrangement (e.g., by manner of turning an inserted physical key). Correspondingly, the earlier mentioned control mechanism can be in the form of a physical key. Therefore, it is yet further appreciable that the actuating mechanism 108 can be generally regarded as a mechanical based actuating mechanism (i.e., mechanical based actuation), according to an embodiment of the disclosure.

In another example, it is earlier mentioned that, in one embodiment, the first support part 212 can be a master support part relative to the second support part 214 and the second support part 214 can be considered to be a slave support part relative to the first support part 212. It is appreciable that, in another embodiment, the first support part 212 can be a slave support part whereas the second support part 214 can be a master support part.

In yet another example, when the shackle 104 is coupled to the body 102, the shackle 104 can be considered to be a "Retained" Shackle (i.e., as a default configuration of the lock 100, the shackle 104 remains coupled to the body 102 when a retaining pin (not shown) for retaining the shackle 104 is inserted).

In yet a further example, the shackle 104 can be removed from the body 102, in an embodiment of the disclosure. When the shackle 104 is removed from the body 102, the shackle 104 can be considered to be a "Removed" Shackle (e.g., the shackle 104 can be effectively pulled off the body 102 and be completely loose when the aforementioned retaining pin is removed).

In the foregoing manner, various embodiments of the disclosure are described for addressing at least one of the foregoing disadvantages. Such embodiments are intended to be encompassed by the following claims, and are not to be limited to specific forms or arrangements of parts so described and it will be apparent to one skilled in the art in view of this disclosure that numerous changes and/or modification can be made, which are also intended to be encompassed by the following claims.

The invention claimed is:

1. A lock assembly comprising:

a lock body;

a shackle partially located within the lock body and configured to move relative to the lock body;

a pair of locking members within the lock body, wherein the pair of locking members are configured to movably engage the shackle to prevent movement of the shackle in a locked configuration and to movably disengage from the shackle in an unlocked configuration;

a locking mechanism coupled to the pair of locking members, wherein movement of the locking mechanism corresponds with the movement of the pair of locking members, a guard slidably engageable with the locking mechanism, wherein the guard is slidably movable laterally between a deployed position that blocks an access region in the lock body and a retracted position that creates the access region in the lock body, wherein when in the deployed position, the guard is configured to slidably move so as to block the access region and to cause the locking mechanism to move out of the access region and to move the pair of locking members into the locked configuration, and when in the retracted position, the guard is configured to slidably move so as to create the access region to allow the locking mechanism to move into the access region and to cause the pair of locking members to move into the unlocked configuration; and an actuating mechanism configured to engage the guard so as to cause the guard to move between the deployed position and the retracted position, wherein the actuating mechanism receives a control signal from a control mechanism for causing the guard to move between the deployed position and the retracted position, the control signal generated by a user on a user interface.

2. The lock assembly according to claim 1, wherein the control mechanism is further configured to selectively move the actuating mechanism so as to cause the guard to move between the deployed position and the retracted position.

3. The lock assembly according to claim 1, wherein the pair of locking members further comprise a first head capable of engaging and disengaging with a first pocket of the shackle and a second head capable of engaging and disengaging with a second pocket of the shackle.

4. The lock assembly according to claim 1, wherein the locking mechanism comprises a first support part and a second support part, each of the first and second support parts having a first end coupled to each one of the pair of locking members, and each of the first support part and second support having a second end coupled to each other.

5. The lock assembly according to claim 4, wherein the guard is slidably movable to the retracted position such that the access region is created and configured to allow the locking mechanism to enter the access region, whereby the first support part and second support part are urged towards each other such that the pair of locking members are disengaged from the shackle.

6. The lock assembly according to claim 5, wherein the guard is slidably movable to the deployed position such that the guard blocks the access region and causes the first support part and second support part to be urged away from each other to cause the pair of locking members to engage the shackle.

7. The lock assembly according to claim 4, wherein when the shackle is in the locked configuration and the guard is blocking the access region, movement of the first support part and movement of the second support part are impeded so that the further movement of the shackle is impeded, thereby maintaining the shackle in the locked configuration.

8. The lock assembly according to claim 4, wherein when the pair of locking members are engaged with the shackle in the locked configuration, the first support part and the second support part are urged away from each other.

9. The lock assembly according to claim 4, wherein when the pair of locking members are disengaged with the shackle in the unlocked configuration, the first support part and the second support part are urged towards each other.

10. The lock assembly according to claim 4, wherein the first support part corresponds to a master lever relative to the second support part and the second support part corresponds to a slave lever relative to the first support part, and wherein the master lever acts to drive the slave lever in a manner so as to facilitate ease in urging the first and second heads one of toward each other and away from each other.

11. The lock assembly according to claim 4, wherein each of the locking members corresponds to a curvilinear protrusion associable with a curvilinear surface, and wherein each of the first and second pockets corresponds to a curvilinear pocket associable with a curvilinear surface.

12. The lock assembly according to claim 11, wherein each curvilinear protrusion corresponds to a convex based curvilinear surface and each curvilinear pocket corresponds to a concave based curvilinear surface.

13. A locking mechanism located within a lock body, the lock body having a shackle partially located within the lock body and configured to move relative to the lock body, the locking mechanism comprising:

a pair of locking members configured to movably engage the shackle to prevent movement of the shackle in a locked configuration and to movably disengage from the shackle in an unlocked configuration;

an actuating mechanism coupled to the pair of locking members, wherein movement of the actuating mechanism corresponds with the movement of the pair of locking members, a guard slidably mounted within the lock body, and the guard is slidably movable laterally between a deployed position that blocks an access region in the lock body and a retracted position that creates the access region in the lock body, wherein when in the deployed position, the guard is configured to slidably move so as to block the access region and to cause the locking mechanism to move out of the access region and to move the pair of locking members into the locked configuration, and when in the retracted position, the guard is configured to slidably move so as to create the access region to allow the locking mechanism to move into the access region and to cause the pair of locking members to move into the unlocked configuration;

wherein the actuating mechanism is configured to engage the guard so as to cause the guard to move between the deployed position and the retracted position, wherein the actuating mechanism receives a control signal from a control mechanism for causing the guard to move between the deployed position and the retracted position, the control signal generated by a user on a user interface.

* * * * *